US005363345A

United States Patent [19]

Boucher et al.

[11] Patent Number: 5,363,345

[45] Date of Patent: Nov. 8, 1994

[54] PROCESS AND ELECTRO-ACOUSTIC TRANSDUCERS FOR TRANSMITTING LOW-FREQUENCY ACOUSTIC WAVES IN A LIQUID

[75] Inventors: Didier Boucher; Yves Ripoll, both of Six-Fours-Les-Plages, France

[73] Assignee: L'Etat Francais represente par . . . le Delegue Ministerial pour l'Armement, Paris, France

[21] Appl. No.: 360,951

[22] Filed: May 3, 1989

[30] Foreign Application Priority Data

May 5, 1988 [FR] France ..... 8806023

[51] Int. Cl.[5] ..... H04R 17/00

[52] U.S. Cl. ..... 367/162; 367/157; 367/158; 310/322; 310/337

[58] Field of Search ..... 310/337, 322; 367/157, 367/158, 162, 165, 166, 167, 171, 172

[56] References Cited

U.S. PATENT DOCUMENTS 3,311,873 3/1967 Schloss ..... 310/337

3,827,459 5/1989 Franklin ..... 367/158

4,866,683 9/1989 Phillips ..... 367/157

*Primary Examiner*—Lobo: Ian J.

*Attorney, Agent, or Firm*—Oliff & Berridge

[57] ABSTRACT

The invention relates to processes and electro-acoustic transducers for transmitting low-frequency acoustic waves in a liquid. An electro-acoustic transducer according to the invention is a transducer of the double-tonpilz type, comprising two electro-acoustic drivers (1*a*, 1*b*) in line on both sides with a central counter-mass (2) and between two horns (3*a*, 3*b*). This mechanical assembly is located in a rigid box (4) which is fitted with side holes (5) and which delimits a cavity (7) housing elastic tubes (6) closed at their both ends and filled with gas so that the Helmholtz resonant frequency of the cavity (7) is close and preferably lower than the fundamental frequency of the axial vibrations of the vibrating assembly. An application of the invention is the construction of low-frequency transmitting transducers of the double-tonpilz type with a wide pass-band.

13 Claims, 4 Drawing Sheets

PROCESS AND ELECTRO-ACOUSTIC TRANSDUCERS FOR TRANSMITTING LOW-FREQUENCY ACOUSTIC WAVES IN A LIQUID

BACKGROUND OF THE INVENTION

The present invention relates to processes for transmitting low-frequency acoustic waves in a liquid by means of electro-acoustic transducers of the double-tonpilz type and transducers which implement these processes. The technical sector of the invention is that of the construction of electro-acoustic transducers.

Known in the prior art are electro-acoustic transducers, especially piezo-electric transducers, referred to as double-tonpilz transducers, which comprise a rigid cylindrical box, open at both ends and, inside the said box, disposed coaxially with the latter, two identical electro-acoustic drivers, for example two stacks of piezo-electric plates which are in line and located on both sides of a central counter-mass and between two horns. The outer faces of the two horns are located in the plane containing axial ends of the box, so that they are in contact with the liquid in which the box is immersed.

The outer faces transmit acoustic waves in the liquid when the electro-acoustic drivers are excited electronically. These double-tonpilz transducers are used in particular for transmitting low-frequency acoustic waves in the water in a given direction.

One of the problems posed by this type of transducers is the elimination of the acoustic waves transmitted by the near faces of the horn.

A solution to this problem consists in using sealed boxes filled with gas. This solution entails the necessity for the box of withstanding the immersion pressures which can be high-level pressures.

Another solution consists in placing at the rear of the horns static masses or dampers referred to as "baffles" which absorb the rear radiation.

SUMMARY OF THE INVENTION

The present invention proposes new means for eliminating the near radiation, which constitutes a new solution to this problem.

A process according to the invention is characterized by the fact that holes are pierced in the side walls of the said box and that elastic tubes closed at both ends and filled with gas are placed in the cavity delimited by the said wall, the outer faces of the horns and the said electro-acoustic drivers, and that the dimensions and positions of the said holes and of the said tubes are determined so that the Helmholtz frequency of the said cavity will be close to the fundamental frequency of the axial vibrations of the mechanical assembly formed by the said electro-acoustic drivers, the said counter-mass and the said horns.

According to a preferred process, the dimensions and positions of the side holes pierced in the box and of the elastic tubes are determined so that she Helmholtz resonant frequency of the cavity delimited by the box, the rear faces of the horns and the electro-acoustic drivers will be lower than the fundamental frequency of the axial vibrations of the mechanical assembly formed by the two electro-acoustic drivers, the two horns and the central counter-mass, which results in a wider pass-band of the transducer towards low-frequencies.

The invention results in new transducers of the double-tonpilz type wherein the energy radiated by the rear faces of the horns is used mainly for causing the cavity delimited (x) to resonate, so that the influence of the radiation outside the box will not be in opposition of phase with the radiation emitted by the horns, which precludes every unwanted interference of the rear radiation with the waves transmitted by the front faces of the horns.

The transducers according to the invention wherein the side holes pierced in the box and the tubes are sized and positioned for the Helmholtz resonant frequency to be lower than the fundamental frequency of the axial vibrations of the two electro-acoustic drivers, the counter-mass and the two horns are transducers which have a wider pass-band towards low-frequencies. For example, a transducer according to the invention having a fundamental frequency of axial vibrations on the order of 900 Hz and a Helmholtz resonant frequency on the order of 650 Hz has a pass-band ranging from 600 Hz to 1000 Hz with a level of transmission reduced to 1 meter, expressed in micropascal per Volt greater than 130 db throughout the pass-band.

BRIEF DESCRIPTION OF THE DRAWINGS

The following description refers to the attached drawings which represent, without any limiting character, several embodiments of electro-acoustic transducers according to the invention.

DESCRIPTION OF THE PREFERRED EMBODIMENTS

Figure 1:
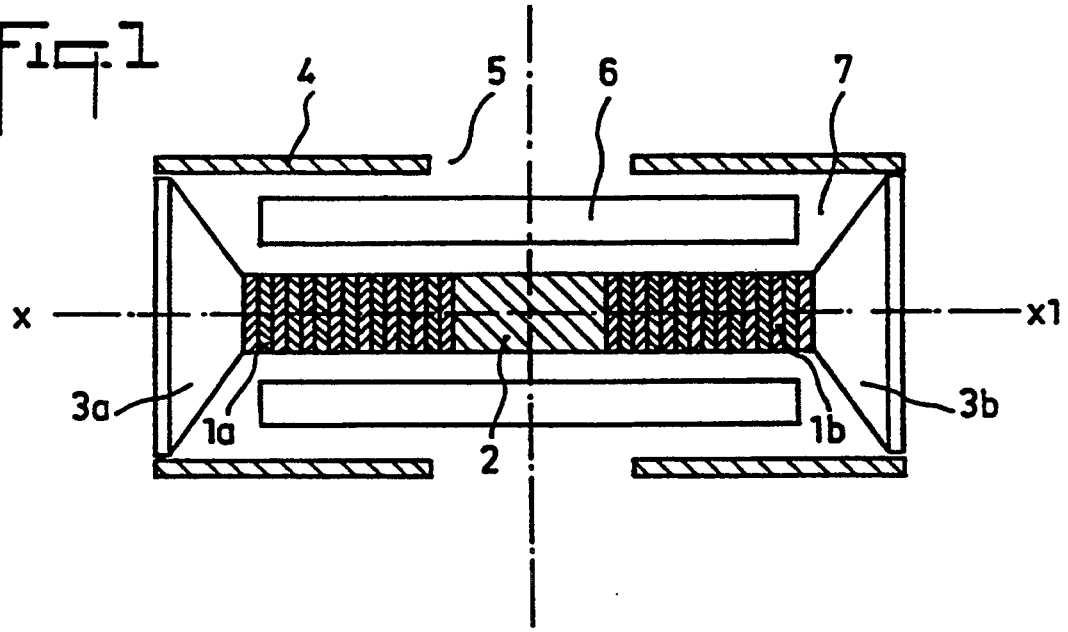
FIG. 1 is a schematic axial cross-sectional view of an electro-acoustic transducer according to the invention.

FIG. 1 is a schematic axial cross-sectional view of an electro-acoustic transducer of the double-tonpilz type, which comprises two electro-acoustic drivers 1*a*, 1*b*, which are for example, two stacks of piezo-electris ceramic plates. The two drivers 1*a*, 1*b* are located on both sides of a central countermass 2. They are located between two horns 3*a*,3*b*. The drivers, the counter-mass and the two horns are in line with a common axis x—x 1.

Usually, this assembly is located inside a rigid box 4, which is generally a coaxial cylindrical box open at its both ends (axial ends), housing the two horns 3*a*, 3*b* the outer faces of which are in contact with a liquid in which the box is immersed and constitute two surfaces which transmit acoustic waves in the liquid.

These transducers of the double-tonpilz type are well known to those skilled in the art.

One of the problems posed by this type of transducers is the problem of the elimination or reduction of the acoustic waves transmitted by the rear faces of the horns.

The present invention provides a new solution to this problem.

The box 4 of a transducer according to the invention is fitted with side holes 5 through which the liquid enters inside the box. It comprises tubes 6 made of an elastic material, which are closed at their both ends and which are filled with gas.

The tubes 6 are housed in the cavity delimited by the drivers 1*a*, 1*b*, the rear faces of the horns and the side walls of the box 4. Preferably, they have a flattered shape and are disposed with their generatrices parallel to the axis x—x 1.

The acoustic waves transmitted by the rear faces of the horns in the cavity 7 distort elastically the tube and the cavity housing the tubes at a natural frequency which can be resonant with the exciting frequency. This phenomenon is known by physicists as Helmholtz resonance.

If we consider a container with a rigid wall which delimits a cavity filled with a fluid which communicates with the outside through a neck and if we excite acoustically the fluid contained in this cavity, for a given exciting frequency, a resonance takes place, known as Helmholtz resonance.

In the present case, the cavity 7 housing the tubes 6 plays the role of a Helmholtz cavity and the holes 5 constitute the neck of the cavity.

When the horn vibrates, it generates a direct flow of acoustic waves through its front face and a reverse flow through its rear face which is equal to the direct flow and of opposite sign.

If the Helmholtz resonance frequency of the cavity 7 corresponds to the exciting frequency, the reverse flow causes the cavity 7 to resonate and under certain conditions , the acoustic transmission of the resonator neck i.e. of the holes 5 is quasi in phase with the direct flow and the resulting sound level is the vector sum of the direct flow and the flow transmitted by the resonator neck.

The Helmholtz resonant frequency of a given cavity can be calculated or measured experimentally and it is thus possible to determine the nature, the shape, the size and the layout of the tubes, as well as the dimensions of the holes 5 so that the Helmholtz frequency will be close to the fundamental frequency of the axial expansion-compression vibrations of the mechanical assembly constituted by the two drivers 1*a*, 1*b*, the counter-mass 2 and the two horns 3*a*, 3*b*.

When the Helmholtz frequency of the cavity with its tubes is close to the transmitting frequency, the Helmholtz resonance takes place and the maximum acoustic energy radiated by the rear faces of the horns is used for maintaining the Helmholtz resonance and the propagation of unwanted acoustic waves outside the box is thus considerably reduced.

Advantageously, the tubes and the holes 5 are calculated so that the Helmholtz resonant frequency will be slightly lower than the fundamental frequency of the mechanical assembly constituted by the double-tonpilz transducer, which makes it possible to widen the transducer pass-band towards low-frequencies.

Figure 2:
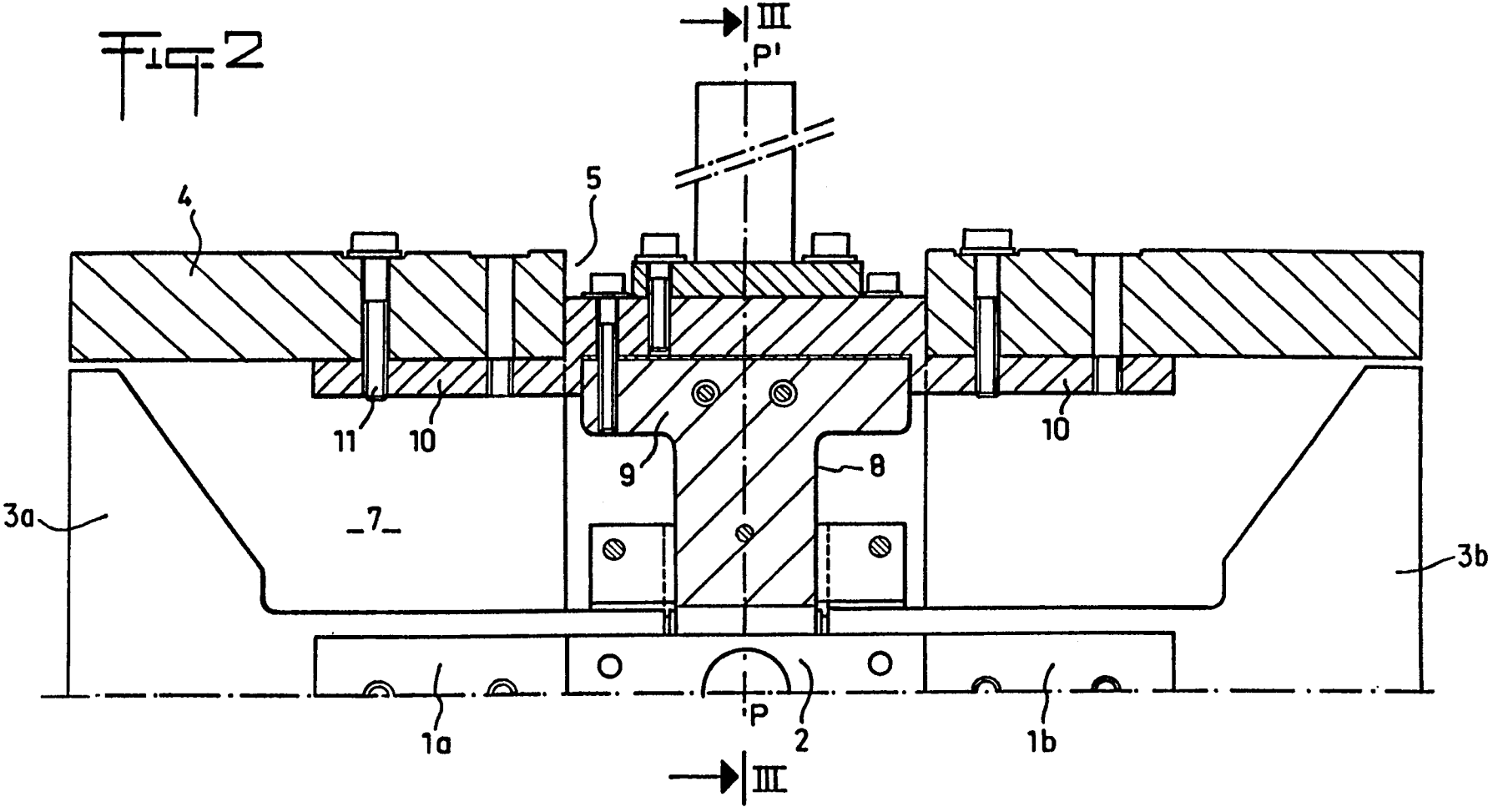
FIG. 2 is an axial half-cross-sectional view of a first embodiment of a transducer according to the invention.
Figure 3:
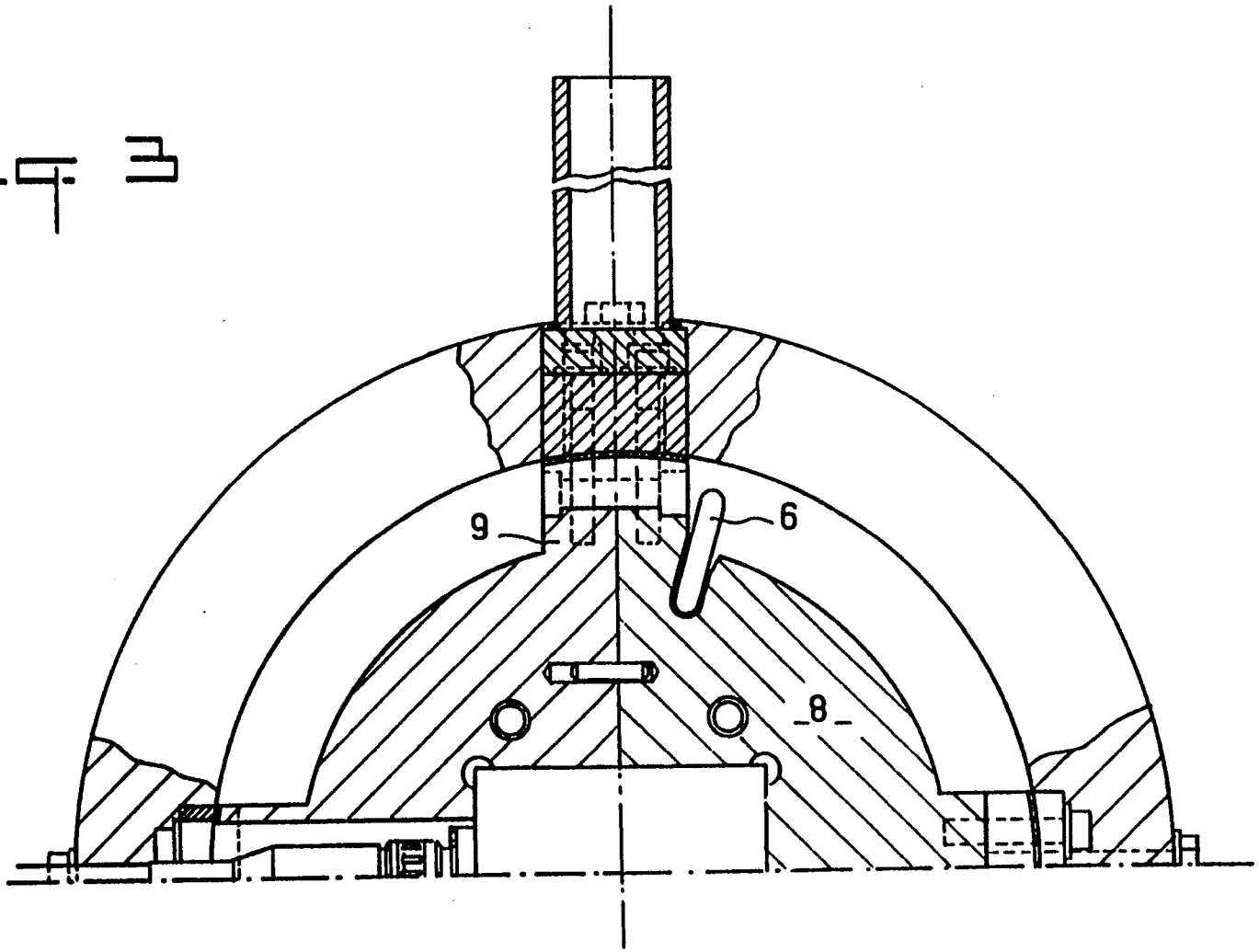
FIG. 3 is a transverse half-cross-sectional view of FIG. 2.

FIGS. 2 and 3 are an axial half-cross-sectional view and a transverse half-cross-sectional view of a first embodiment of a transducer according to the invention. The homologous parts are represented by the same datum marks on FIGS. 1, 2 and 3.

The box 4 is fitted with a peripheral hole 5 symmetrical as to a medial plane PP′ perpendicular to the axis x—x 1.

The counter-mass 2 is fitted with a central plate 8 having the shape of a disk with an outer diameter substantially equal to the inner diameter of the box 4.

The disk is fitted on its both faces with notches which accommodate the tubes 6 shown in FIG. 3. The tubes 6 are not shown in FIG. 2 so as to make the drawing clearer.

FIG. 3 shows an embodiment wherein the tubes 6 have a flattened shape and are disposed radially.

The disk 8 is fitted, on its periphery, with four attachment parts forming a cross. Each part 9 is secured to the disk periphery and includes two arms which extend on both sides of the disk and are attached by means of bolts 11 to the side walls of the box 4 extending on both sides of the hole 5. The function of these two parts 9, 10 is to connect mechanically together the two parts of the box 4 separated by the hole 5.

The dimensions, the shape, the nature and the layout of the tubes 6, as well as the size of the hole 5, vary with the size of the transducer. They are calculated so that the Helmholtz resonant frequency of the cavity 7 having a neck 5 and housing the tubes 6 will be close and preferably slightly lower than the fundamental frequency of the axial vibrations off the double-tonpilz transducer.

The walls of the box 4 are thick walls made of metal or composite material which are very rigid and do not vibrate. The tubes 6 are made of a very elastic material such as spring-loaded steel or glass or carbon fiber laminates. The flattened shape of the tubes is a preferred shape which facilitates the bending vibrations of the side walls of the tubes.

Figure 4:
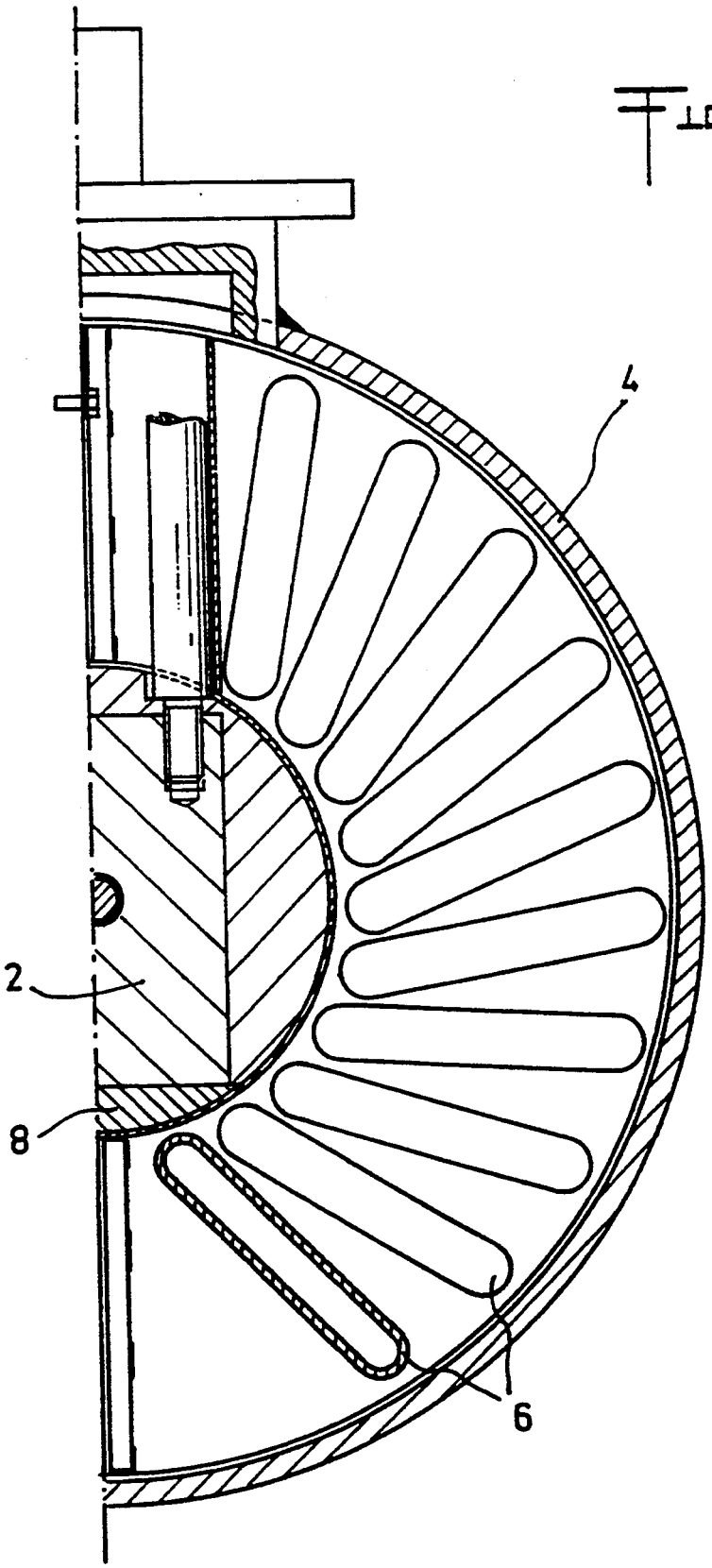
FIG. 4 is a transverse half-cross-sectional view of a second embodiment of a transducer according to the invention.

FIG. 4 is a transverse half-cross-sectional view of another embodiment of a transducer according to the invention. The homologous parts are represented by the same datum marks. In this embodiment, the tubes 6 are not disposed radially. They assume a fan-shaped layout, i.e. each tube is placed obliquely as to the radial direction.

Figure 5:
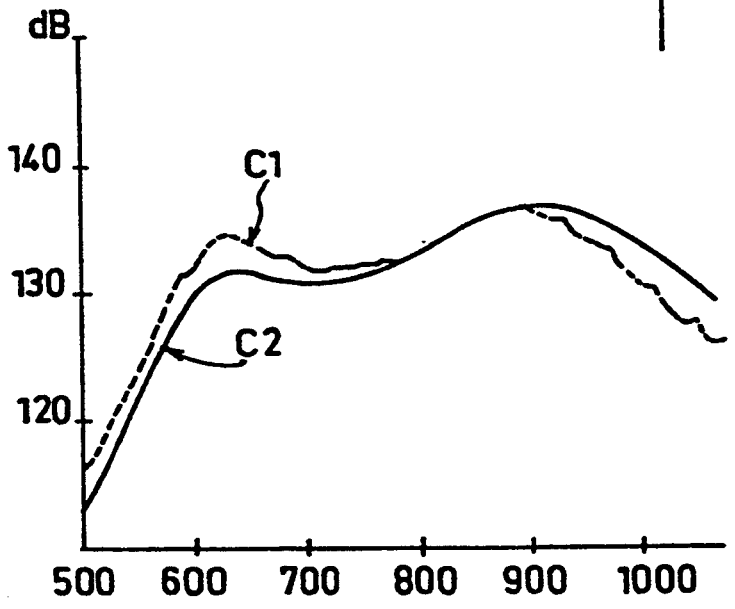
FIG. 5 is a diagram which represents the transmission level of a transducer according to the invention versus the excitation frequency.

FIG. 5 is a diagram showing along the abscissa the exciting frequency and along the ordinate the transmitting level of a transducer according to the invention expressed in decibels, i.e. the logarithm of the pressure in micropascals obtained for an excitation of 1 volt, measured at a distance of 1 meter from the transducer. The diagram corresponds to a transducer fitted with a side hole 5, 15 cm wide and containing 17 tubes 6. The diagram shows that the width of the pass-band obtained is between 600 Hz and 1000 Hz. The curve C1 represents the transmitting level SV along the transducer center-line and the curve C2 the transmitting level SV on a plane perpendicular to the transducer center-line.

What is claimed is:

1. A process for transmitting low-frequency acoustic waves in a liquid by means of an electro-acoustic transducer of the type comprising a cylindrical rigid box; two identical electro-acoustic drivers inside said box, in line coaxially with said box and located on both sides of a central counter-mass; and two horns which are located at axial ends of said drivers and said box and outer faces of which are in contact with liquid; characterized in that holes are pierced in a side wall of said box and that a cavity delimited by said wall, rear faces of said horns and said electro-acoustic drivers houses elastic tubes closed at both ends and filled with gas, and that dimensions and positions of said holes and of said tubes are determined so that a Helmholtz resonant frequency of said cavity will be close to a fundamental frequency of axial vibrations of a mechanical assembly constituted by said electro-acoustic drivers, said counter-mass and said horns.

2. The process according to claim 1, characterized in that said dimensions and positions of said holes and said elastic tubes are determined so that said Helmholtz resonant frequency of said cavity will be lower than said fundamental frequency of axial vibrations of said mechanical assembly.

3. An electro-acoustic transducer comprising:

a cylindrical box open at both axial ends;

two identical electro-acoustic drivers located inside of said box;

a central counter-mass between said drivers; and two horns in line coaxially with said box, said horns being located at axial ends of said drivers and said box, so that their outer faces are in contact with liquid and transmit low-frequency acoustic waves in said liquid when said two drivers are excited electrically;

said box delimiting a cavity with rear faces of said horns and with said electro-acoustic drivers, and said box being fitted with side holes and housing elastic tubes closed at both ends and filled with gas, dimensions and positions of said side holes and said tubes being determined so that a Helmholtz resonant frequency of said cavity will be close to a fundamental frequency of axial vibrations of a mechanical assembly constituted by said two electro-acoustic drivers, said counter-mass and said horns.

4. The electro-acoustic transducer according to claim 3, characterized in that said dimensions and positions of said side holes and said tubes are determined so that said Helmholtz resonant frequency of said cavity will be lower than said fundamental frequency of axial vibrations of said mechanical assembly.

5. The transducer according to claim 3, characterized in that said tubes are flattened tubes.

6. The transducer according to claim 3, characterized in that said tubes are made of an elastic steel.

7. The transducer according to claim 3, characterized in that generatrices of said tubes are parallel to a longitudinal axis of said cylindrical box.

8. The transducer according to claim 5, characterized in that said flattened tubes are disposed so that longitudinal cross-sectional axes of said flattened tubes extend radially from a longitudinal axis of said box.

9. The transducer according to claim 5, characterized in that said flattered tubes are disposed so that longitudinal cross-sectional axes of said flattened tubes extend at a constant angle with respect to radii from a longitudinal axis of said box.

10. The transducer according to claim 3, characterized in that said box is fitted with a side hole which extends throughout the periphery of said box and which is symmetrical with respect to a symmetry plane perpendicular to a center line of said box.

11. The transducer according to claim 3, characterized in that said tubes are made of an elastic reinforced laminate.

12. The transducer according to claim 11, characterized in that said laminate is reinforced with glass.

13. The transducer according to claim 11, characterized in that said laminate is reinforced with carbon fiber.

* * * * *